US007987808B1

(12) United States Patent
Evans

(10) Patent No.: US 7,987,808 B1
(45) Date of Patent: Aug. 2, 2011

(54) DUAL-MODE ROADSIDE ASSISTANCE FLAG

(76) Inventor: Terry L. Evans, Charlotte, NC (US)

( * ) Notice: Subject to any disclaimer, the term of this patent is extended or adjusted under 35 U.S.C. 154(b) by 225 days.

(21) Appl. No.: 12/481,850

(22) Filed: Jun. 10, 2009

(51) Int. Cl.
*G09F 17/00* (2006.01)
*G09F 21/04* (2006.01)

(52) U.S. Cl. ..... 116/28 R; 116/173

(58) Field of Classification Search ..... 116/28 R, 116/173; 40/591, 592, 593; D11/165, 166, D11/181, 182
See application file for complete search history.

(56) References Cited

U.S. PATENT DOCUMENTS

| | | | | |
|---|---|---|---|---|
| 2,398,748 | A * | 4/1946 | Lange et al. | 248/539 |
| 3,791,336 | A * | 2/1974 | Zdebski | 116/28 R |
| 4,002,138 | A | 1/1977 | Dobala | |
| D271,190 | S * | 11/1983 | Dostourian | D11/181 |
| 4,590,883 | A | 5/1986 | Steed et al. | |
| 5,226,792 | A | 7/1993 | Darago | |
| 5,233,938 | A | 8/1993 | Lalo | |
| 5,974,711 | A * | 11/1999 | Tipke | 40/591 |
| 6,276,080 | B1 * | 8/2001 | Brennan | 40/591 |
| 6,378,453 | B1 | 4/2002 | Conway | |
| D607,374 | S * | 1/2010 | Durkin | D11/182 |
| 7,878,139 | B1 * | 2/2011 | Karnes et al. | 116/28 R |

FOREIGN PATENT DOCUMENTS

DE 102004003991 A1 * 8/2004

* cited by examiner

*Primary Examiner* — R. A. Smith
(74) *Attorney, Agent, or Firm* — QuickPatents, Inc.; Kevin Prince

(57) ABSTRACT

The present teachings relate to a flag assembly for use with a vehicle having a window that retracts from a closed position to an open position. The flag assembly comprises an elongated post having an upper end, a lower end, and a waist portion disposed between the upper end and the lower end. A window edge retaining means projects outwardly from the waist portion, and is configured to be received by a window. The lower end of the elongated post is configured to be inserted between the window and a door frame of the vehicle. The upper end of the elongated post comprises a flag holding means that is configured to hold an alert flag within. The flag assembly can be inserted between the window and an upper frame of the vehicle, or it can be inserted between the window and a door frame of the vehicle.

13 Claims, 3 Drawing Sheets

DUAL-MODE ROADSIDE ASSISTANCE FLAG

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to alert flags, and more particularly to a dual-mode alert flag for is vehicles.

DISCUSSION OF RELATED ART

Flags have been employed in conjunction with motor vehicles for conveying distress signals with respect to disabled vehicles, for promoting sales and or rentals, as for example, in car lots, for distinguishing one's car from others in parking lots, and for the traditional purposes of indicating patriotism, national origin, etc. as is often displayed on slow moving vehicles in motorcades and parades. As will be appreciated, a flag system needs to be durable to withstand the elements of the outdoors, for example, snow, wind, sleet, rain, and the like. At the same time, a flag system needs to be attachable to the vehicle, either to the vehicle's body or into a window or groove within the vehicle.

An exemplary auto safety flag and holder is described in U.S. Pat. No. 4,002,138 to Dobala, on Jan. 11, 1977. The flag and holder provide a motorist with a safety device which can be used from inside a motorist's car by lowering the window halfway and mounting the flag and holder on his window, thereby displaying a warning to traffic from either direction that his car is disabled and in need of assistance. Such a flag holder is only useful when the motorist or other safety person has access to the interior of the car. The reason for this is that the window must be lowered from within the car.

U.S. Pat. No. 4,590,883 to Steed et al., on May 27, 1986, describes a flag and flag mounting, where the flag is formed from a durable material and mounted on a supporting rod clipped into a handle. The flag is retained between the handle and a knob on the rod. The handle can be inserted into a mounting block that is adapted to be retained between a car window glass and an upper frame of a vehicle door, or be attached to a mounting suction cup. The drawback to this flag and flag mounting is that if you don't have access to the interior of the car, the only way to attach the flag to the car is by first attaching a suction cup stand to the vehicle. Suction cups are not a very durable means of support for outdoor conditions such as wind, rain, and snow.

U.S. Pat. No. 5,226,792 to Darago, on Jul. 13, 1993, describes a distress flag for a vehicle where the flag is made of foldable material. The distress flag is positionable in use over the top edge of a window of a vehicle so that it can hang downwardly, displaying a printed message. For storing the flag when not in use, a pocket is fixed to the distress flag so that the flag can be folded into a compact form and placed within the pocket. The drawbacks of such a flag are similar to those as the safety flag of Dobala. The only way the distress flag can be mounted to the vehicle window is if the window is first opened so that the flag itself can be inserted into the window, and the window is closed to thereby hold the distress flag in place. The distress flag is only useable when a person has access to the interior of the vehicle.

U.S. Pat. No. 5,233,938 to Lalo, on Aug. 10, 1993, describes a vehicle flag system that includes a flag, a flag mast and a window mount. The flag mast includes a base configured to be lockingly received in a socket formed in the window mount. The mast base is formed with an axial tenon which mates with a mortise formed in the socket. A pair of spring legs project from the base parallel to the tenon and each is received within a channel formed in the socket. The spring legs include enlarged latches at their ends and the spring legs are compressed toward the tenon when the tenon is inserted into the mortise. When the tenon seats fully in the mortise, the latches register with cut out portions of the socket wall and spring outwardly. To release the base from the socket, the latches are manually compressed toward the tenon. In order to attach the window mount to a vehicle window, the window must first be opened, and the mount must then be inserted. To secure the mount, it is preferable that the window is then closed. The drawback of such a mount has been mentioned above. A person that desires to use the flag system must have access to the interior of the vehicle.

U.S. Pat. No. 6,378,453 to Conway, on Apr. 30, 2002, describes a vehicle locator device includes a flag with recognizable indicia thereon, wherein the flag is supported above the top height of the vehicle by an elongated compression spring pole or mast at a distal end thereof. The vehicle locator is foldable about itself into a loop, so that it can be reduced in size and fit within the glove compartment of a vehicle for storage when not in use. The mast must be inserted into a mount that is only configured to be held in place by the top frame of a vehicle window. As mentioned previously, the drawbacks associated with this type of device are that a person must have access to the interior of the vehicle to roll down the vehicle window.

Therefore, clearly there is a need for a device that can be inserted into the top frame of the window of a vehicle when the user has access to the interior of the vehicle, and there is a need for a device that can also be inserted somewhere else on the vehicle when a user does not have access to the interior of the vehicle. Further, the device needs to be stable enough to withstand the elements of the outdoors, while at the same time be easily transported and stored. The present invention accomplishes these objectives.

SUMMARY OF THE INVENTION

The present device is a flag assembly for use with a vehicle having a window that retracts from a raised position engaged with an upper frame of the vehicle into a lowered position into a door frame of the vehicle. The flag assembly comprises an elongated post having an upper end and a lower end, where the lower end is adapted for insertion between the window and the door frame of the vehicle to retain the flag assembly therebetween. The upper end includes a flag holding means, and the elongated post further includes a waist portion. In some embodiments the elongated post can be tapered such that the width of the elongated post gradually decreases from the waist portion to the lower end of the elongated post. The flag holding means is configured to secure a flag within. In some embodiments, the flag holding means comprises one or more flag hooks. In some embodiments, the flag holding means can include a V-shaped portion that can be adapted to frictionally retain the alert flag between two sections of the V-shaped portion.

The flag assembly further comprises a window edge retaining means fixed to the waist portion of the elongated post. The window edge retaining means projects outwardly from one side thereof. The window edge retaining means is adapted to be fixed between the window and the upper frame of the vehicle when the window is in the raised position. In some embodiments, the window edge retaining means can comprise an E-shaped bracket, and an open end of the E-shaped bracket can be oriented towards the lower end of the elongated post. When inserted in between the window and the door frame, the window edge retaining means of the elongated post can project outwardly from the waist portion of the elongated post and provide a standoff for maintaining the alert flag away from the window of the vehicle.

The flag assembly further comprises an alert flag made from a flexible web and adapted along one edge thereof for engagement with the flag holding means of the upper end of the elongated post. In some embodiments, the alert flag can comprise a reflective material disposed on at least one side thereof. In some embodiments, the alert flag can comprise two or more contrasting colors. The alert flag can comprise a hollow hem that can be configured to receive the upper end of the elongated post. The flag assembly has dual modes such that the flag assembly may be fixed between the window and the door frame of the vehicle at the lower end thereof, or around the edge of the window between the window and the upper frame of the vehicle.

The dual modes of the present invention provide a solution to a motorist or security official that does not have access to the interior of a vehicle, but at the same time wants to attach an alert flag assembly to the vehicle. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention relates to a dual-mode flag assembly for use with a vehicle. The flag assembly is for use with a vehicle having a window that retracts from a raised position engaged with an upper frame of the vehicle, and into a lowered position in a door frame of the vehicle. The flag assembly is configured to be used in a first mode that allows a user to insert the flag assembly between the upper portion of the window and an upper frame of the vehicle. The flag assembly is also configured to be used in a second mode that allows a user to insert the flag assembly between the window and the door frame of the vehicle. Such a configuration allows for a user to use the flag assembly even if the user is unable to access the interior portion of the vehicle and unable to roll down the window. The various components of the flag assembly described herein, can be made of any desired materials. For example, the components of the flag assembly can comprise a plastic material, for example, injection molded plastic. In some embodiments, the flag assembly can comprise various desired materials, for example, metal, wood, rubber, plastic, other type of material, or a combination thereof. Each component can comprise similar or different materials as the other various components.

Figure 1:
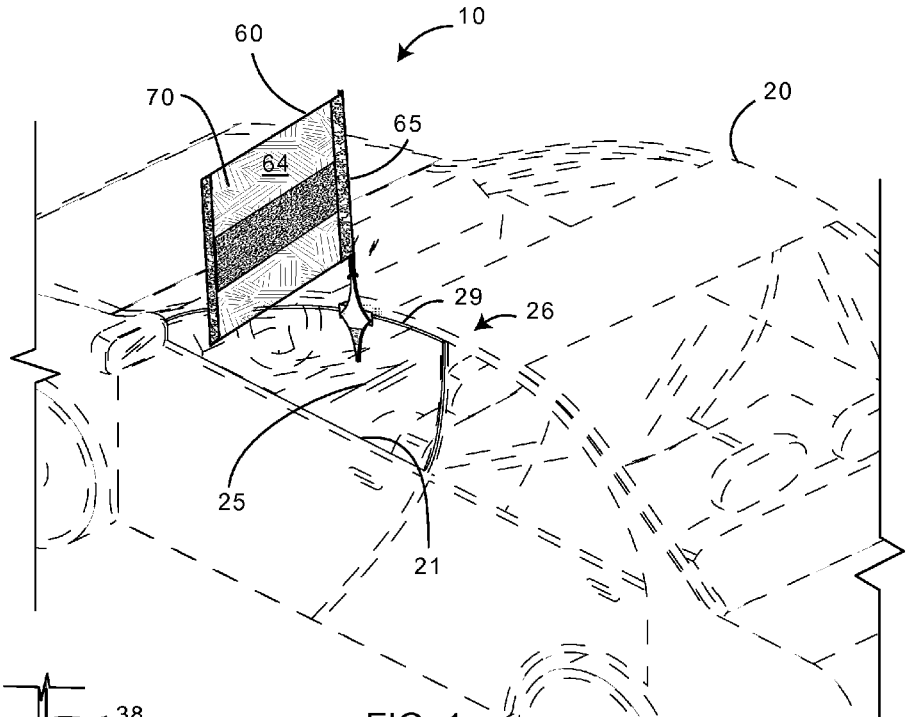
FIG. 1 is a perspective view of the exterior of a vehicle illustrating a flag assembly that comprises an elongated post, a window edge retaining means, and an alert flag inserted into the elongated post, the flag assembly is fixed between the top of a window and an upper frame of the vehicle.

FIG. 1 illustrates an exterior view of a vehicle 20 and a flag assembly 10 that is inserted between the top of window 25 and upper frame 29 of vehicle 20. The window 25 can be retractable between raised portion 26 where the top of the window contacts or almost contacts upper frame 29 of vehicle 20, and a lowered position (not shown). In the lowered position, window 25 can be retracted, for example, manually or electrically, such that the top of window 25 no longer contacts upper frame 29, and such that at least a portion of window 25 retracts into door frame 21 of vehicle 20. When window 25 is retracted, enough space can be formed between upper frame 29 and window 25, such that flag assembly 10 can be attached to window 25. Window 25 can then be raised such that the top of window 25 contacts, or nearly contacts, upper frame 29. This can create a secure hold on flag assembly 10. Flag assembly 10 comprises an alert flag 60 that comprises a flexible web 70. Flexible web 70 can comprise any suitable flexible material, for example, nylon, cotton, linen, silk, other desired flexible material, or a combination thereof. Alert flag 60 comprises an edge 65 that is adapted for engagement with an elongated post 30.

Figure 3:
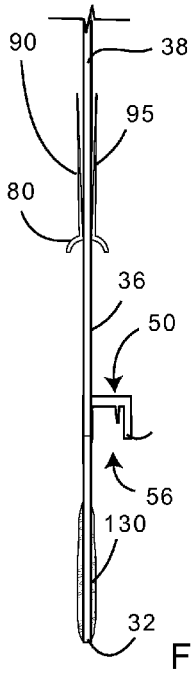
FIG. 3 is a cross-sectional interior view of the elongated post taken along lines cut away line 3-3 as shown in FIG. 2.
Figure 2:
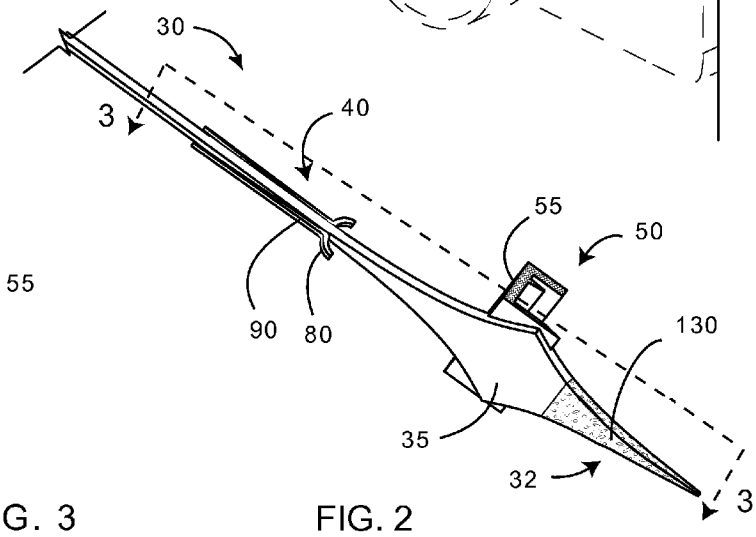
FIG. 2 illustrates an elongated post comprising a lower end that is adapted to be inserted between a door frame and a window of a vehicle, a waist portion comprising a bracket that is configured to be inserted between a window and an upper door frame, and an upper end including a flag holding means.

FIGS. 2 and 3 illustrate elongated post 30. FIG. 3 is a cross-sectional view of elongated post 30 taken along line 3-3 shown in FIG. 2. Elongated post 30 comprises an upper end 38 and a lower end 32 on the opposing side of elongated post 30, with respect to upper end 38. Elongated post 30 comprises a waist portion 35 that is disposed between upper end 38 and lower end 32. In some embodiments, waist portion 35 can be disposed on elongated post 30 such that waist portion 35 is positioned closer to upper end 38, closer to lower end 32, or equally between upper end 38 and lower end 32.

Attached to elongated post 30 is a window edge retaining means 50 that is fixed to waist portion 35 of elongated post 30. Window edge retaining means 50 projects outwardly from one side 36, and is adapted to be fixed between window 25 and upper frame 29 of vehicle 20. Window edge retaining means 50 can be affixed to waist portion 35 by any conventional means, for example, the two components can be formed of one piece or of two or more pieces. The two or more pieces of window edge retaining means 50 can be fastened to each other by any desired method known in the art, for example, by welding, gluing, bolting, or other desired fastening method. In some embodiments, window edge retaining means 50 can comprise an E-shaped bracket 55 and an open end 56 of the E-shaped bracket can be oriented towards lower end 32 of elongated post 30. Window edge retaining means 50 can comprise any desired shape bracket, for example, a C-shaped bracket, a J-shaped bracket, an L-shaped bracket, or other desired bracket shape. The window edge retaining means can be configured to be received by a top portion of window 25.

Lower end 32 of elongated post 30 is adapted for insertion between window 30 and door frame 21. Once inserted between window 30 and door frame 21, lower end 32 is retained therebetween. In some embodiments, lower end 32 can comprise a high friction coating 130 that is configured to provide friction, and thus prevent lower end 32 from moving around between door frame 21 and window 30. High friction coating 130 can comprise of any suitable material, for example, rubber, plastic, foam, other desired material, or a combination thereof. In some embodiments, lower end 32 can comprise a tapered portion such that the width of the elongated post gradually decreases from waist portion 35 to lower end 32. In some embodiments, waist portion 35 can be of larger width than upper end 38. Upper end 38 of elongated post 30 comprises a flag holding means 40 that is configured to engage alert flag 60 along one edge 65, as shown in FIG. 1. In some embodiments, alert flag 60 can comprise an opening that is configured to receive upper end 38 of elongated post 30.

In some embodiments, flag holding means 40 can comprise one or more flag hooks 80. Flag hooks 80 can be configured to hook onto, or through, alert flag 60, in any method well known in the art. In some embodiments, flag holding means 40 can comprise a V-shaped portion 90 configured to frictionally retain alert flag 60 between one or more sections 95 of V-shaped portion 90. Alert flag 60 can comprise a sleeve, a hollowed hem, or an opening that is configured to slide along elongated post 30. V-shaped portion 90 can receive the hollowed hem and can grip the hem with friction, and thereby secure alert flag 60 to elongated post 30. In some embodiments, flag holding means 40 can be manually moved by a user to push V-shaped portion 90 into an open position, such that open space is created between the one or more sections 95 and the elongated post 30. While in an open position, the hollowed hem of alert flag 60 can be inserted into the open space by a user. Once the flag has been inserted, the user can close V-shaped portion 90 thereby causing the one or more sections 95 to contact alert flag 60.

Figure 4:
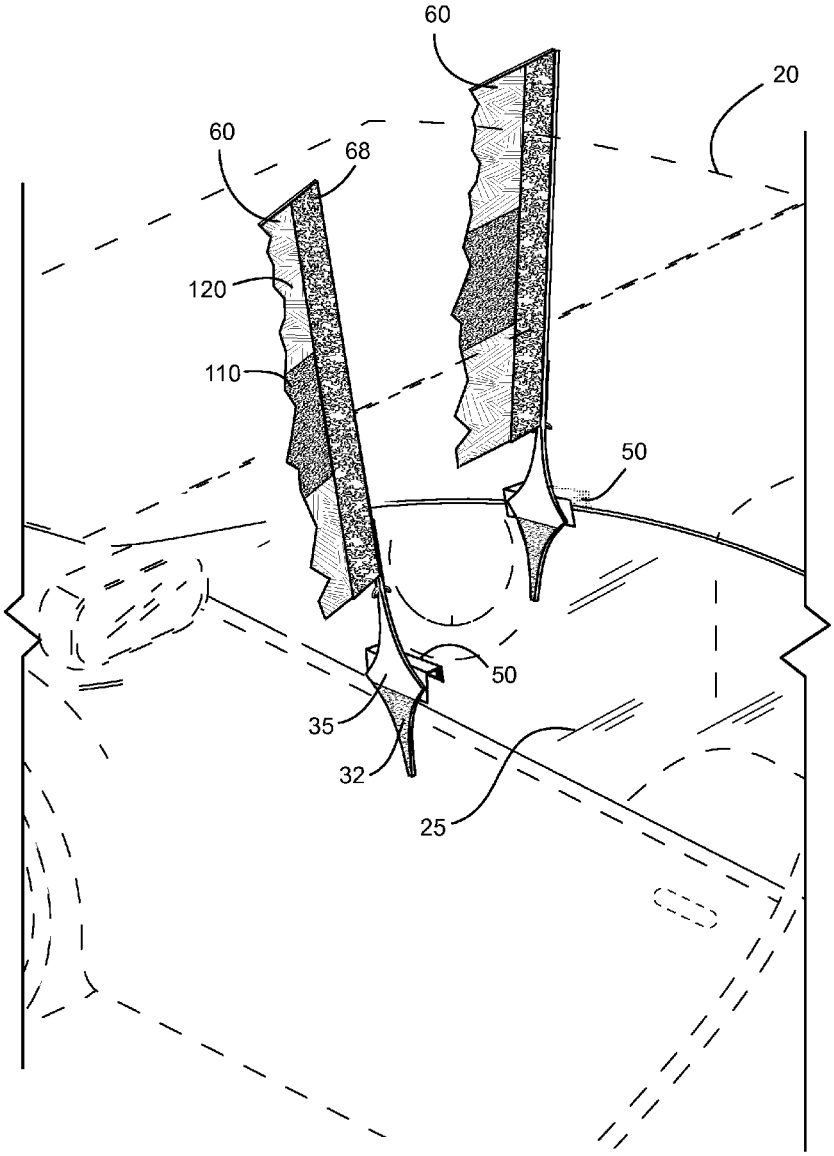
FIG. 4 is a perspective view of an exterior of the vehicle illustrating the dual modes of the flag assembly.
Figure 5:
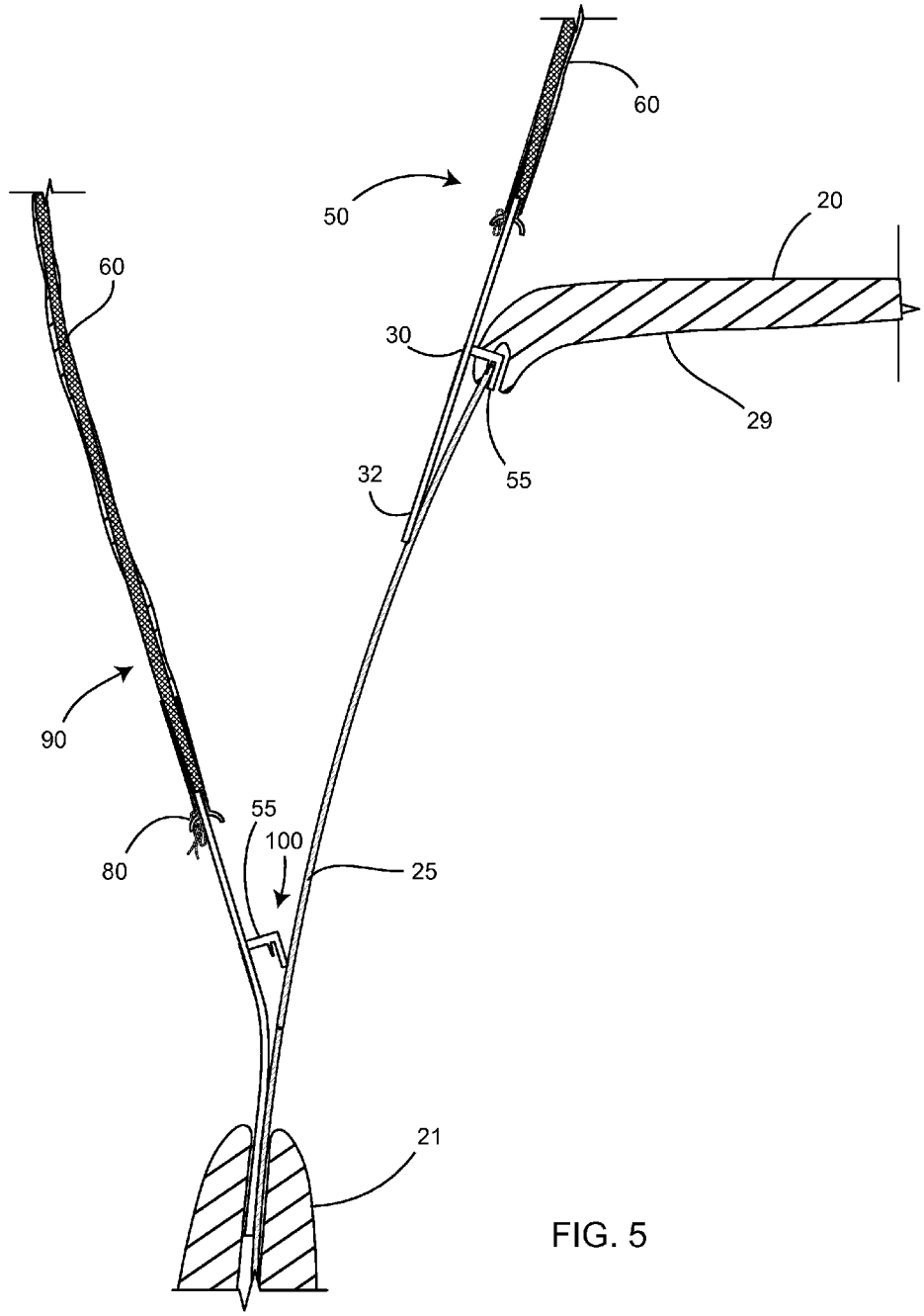
FIG. 5 is a side view of the vehicle in FIG. 4 that shows the dual modes of the flag assembly and illustrates the standoff between the elongated post and the window of the vehicle that can occur when the flag assembly is inserted between the window and the door frame of the vehicle.

FIG. 4 illustrates flag assembly 10 in dual modes. In a first mode, flag assembly 10 has been inserted between the top of window 25 and the bottom of upper frame 29 of vehicle 20. Window edge retaining means 50 is configured to fit onto the top of window 25 as shown in FIG. 5. In some embodiments, window edge retaining means 50 can have a snug fit on window 25, or a loose fit on window 25. As window 25 is brought upwards towards upper frame 29, window edge retaining means 50 can contact upper frame 29, and secure flag assembly 10 to vehicle 20. In some embodiments, the window edge retaining means 50 can comprise an E-shaped bracket 55 that can contact the top of window 25, such that the outward section of the E-shaped bracket snugly fits onto window 25, while the inner section of the E-shaped bracket has open space. A user can insert alert flag 60 onto elongated post 30, and alert flag 60 can be secured by flag holding means 40. In some embodiments, lower end 32 of elongated post 30 can contact window 25, to thereby create more stability for flag assembly 10.

FIGS. 4 and 5 also illustrate a second mode for flag assembly 10, where flag assembly 10 has been inserted between window 25 and door frame 21. This dual mode can be useful for security personnel and others who do not have access to the interior of the vehicle. If the vehicle door is locked, a user can insert the flag assembly 10 without actually having to access the vehicle interior. As shown in FIG. 5, when lower end 32 of elongated post 30 is inserted in between window 25 and door frame 21, such that window edge retaining means projects outwardly from waist portion 35 and is facing towards window 25, a standoff 100 can be created. Such standoff 100 can maintain alert flag 60 away and outwardly from the window 25, thus making it easier for passers-by to see the flag 60. In some embodiments, alert flag 60 can comprise a reflective material 110, that is disposed on at least one side 64 of alert flag 60. In some embodiments, alert flag 60 can comprise two or more contrasting colors 120. Alert flag 60 can comprise a hollow hem 68 that can be configured to receive upper end 38 of elongated post 30.

While a particular form of the invention has been illustrated and described, it will be apparent that various modifications can be made without departing from the spirit and scope of the invention. For example, the elongated post, the window edge retaining means, and/or the flag holding means can comprise any suitable material, for example, plastic, metal, rubber, wood, or other desired material. Further, the alert flag can be attached to the elongated post in any desired method, for example, the elongated post can comprise a number of hooks or openings that can receive a number of hooks or openings disposed on the alert flag. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description."While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A flag assembly for use with a vehicle having a window that retracts from a raised position engaged with an upper frame of the vehicle into a lowered position into a door frame of the vehicle, the flag assembly comprising:

an elongated post having an upper end and a lower end, the lower end adapted for insertion between the window and the door frame of the vehicle to retain the flag assembly therebetween, the upper end including a flag holding means, the elongated post including a waist portion integrally formed therewith;

a window edge retaining means fixed to the waist portion of the elongated post and projecting outwardly from one side thereof, the window edge retaining means adapted to be fixed between the window and the upper frame of the vehicle when the window is in the raised position;

an alert flag made from a flexible web and adapted along one edge thereof for engagement with the flag holding means of the upper end of the elongated post;

whereby the flag assembly may be fixed between the window and the door frame of the vehicle at the lower end thereof, or around the edge of the window between the window and the upper frame of the vehicle.

2. The flag assembly of claim 1 wherein the lower end of the elongated post is tapered.

3. The flag assembly of claim 1 wherein the flag holding means includes at least one flag hook.

4. The flag assembly of claim 1 wherein the flag holding means includes a V-shaped portion adapted to frictionally retain the alert flag therebetween two sections thereof.

5. The flag assembly of claim 1 wherein the waist portion is wider than the upper end and the lower end.

6. The flag assembly of claim 1 wherein the window edge retaining means includes an E-shaped bracket, and an open end of the E-shaped bracket oriented towards the lower end of the elongated post.

7. The flag assembly of claim 1 wherein the window edge retaining means projects outwardly from the waist portion of the elongated post so as to provide a standoff for maintaining the alert flag away from the window of the vehicle.

8. The flag assembly of claim 1 wherein the alert flag includes a reflective material on at least one side thereof.

9. The flag assembly of claim 1 wherein the alert flag includes at least two contrasting colors.

10. The flag assembly of claim 1 wherein the one edge includes a hollow hem for receiving the upper end of the elongated post.

11. The flag assembly of claim 1 wherein the lower end of the elongated post comprises a high friction coating.

12. A flag assembly for use with a vehicle having a window that retracts from a raised position engaged with an upper frame of the vehicle into a lowered position into a door frame of the vehicle, the flag assembly comprising:

an elongated post having an upper end and a tapered lower end, the lower end adapted for insertion between the window and the door frame of the vehicle to retain the flag assembly therebetween, the upper end including at least one flag hook, the elongated post including a waist portion wider than either the upper or lower ends of the elongated post;

an E-shaped bracket fixed to the waist portion of the elongated post and projecting outwardly from one side thereof, an open end of the E-shaped bracket oriented towards the lower end of the elongated post, the E-shaped bracket adapted to be fixed between the window and the upper frame of the vehicle when the window is in the raised position;

an alert flag made from a flexible web and including a hollow hem along one edge thereof for receiving the upper end of the elongated post and for engagement with the at least one flag hook of the upper end of the elongated post, the alert flag including at least two contrasting colors and a reflective material on at least one side thereof, the E-shaped bracket projecting outwardly from the waist portion of the elongated post so as to provide a standoff for maintaining the alert flag away from the window of the vehicle;

whereby the flag assembly may be fixed between the window and the door frame of the vehicle at the lower end thereof, or around the edge of the window between the window and the upper frame of the vehicle.

13. The flag assembly of claim 12 wherein the upper end of the elongated post further includes a V-shaped portion adapted to frictionally retain the alert flag therebetween two sections thereof.

* * * * *